US012442202B2

(12) United States Patent
Richards et al.

(10) Patent No.: US 12,442,202 B2
(45) Date of Patent: Oct. 14, 2025

(54) CONCRETE TROWEL

(71) Applicant: MILWAUKEE ELECTRIC TOOL CORPORATION, Brookfield, WI (US)

(72) Inventors: Ian C. Richards, Shorewood, WI (US); Will Didier, Cedarburg, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 599 days.

(21) Appl. No.: 17/679,360

(22) Filed: Feb. 24, 2022

(65) Prior Publication Data

US 2022/0268036 A1 Aug. 25, 2022

Related U.S. Application Data

(60) Provisional application No. 63/153,057, filed on Feb. 24, 2021.

(51) Int. Cl.
*E04F 21/24* (2006.01)
*E01C 19/42* (2006.01)

(52) U.S. Cl.
CPC ..... *E04F 21/248* (2013.01); *E01C 19/42* (2013.01)

(58) Field of Classification Search
CPC ..... E01C 19/44; E04F 21/248
USPC ..... 404/112
See application file for complete search history.

(56) References Cited

U.S. PATENT DOCUMENTS 2,181,375 A 11/1939 Leistner et al.
2,394,274 A * 2/1946 Troxell ..... E04F 21/248 404/112
2,662,454 A 12/1953 Whiteman
2,875,676 A * 3/1959 Thieme ..... E04F 21/248 404/112
2,882,806 A * 4/1959 Thieme ..... E04F 21/248 404/112
2,888,863 A 6/1959 Eisenbeis
3,402,647 A 9/1968 Colizza et al.
3,683,761 A 8/1972 Babic
4,232,980 A * 11/1980 Tertinek ..... E04F 21/248 404/112
4,312,603 A 1/1982 Whiteman, Jr.
(Continued)

FOREIGN PATENT DOCUMENTS

CN 206693009 U 12/2017
EP 0887489 A1 12/1998
(Continued)

OTHER PUBLICATIONS

International Search Report and Written Opinion for Application No. PCT/US2022/017622 dated Jun. 7, 2022 (11 pages).
(Continued)

*Primary Examiner* — Gary S Hartmann
(74) *Attorney, Agent, or Firm* — Michael Best & Friedrich LLP

(57) ABSTRACT

A concrete trowel includes a frame, a drive assembly including an electric motor mounted on the frame having an output shaft extending from the motor defining a drive axis, a guide handle extending from the frame for controlling the trowel, a battery pack for supplying electrical power to the motor, and a rotor including a plurality of blades, the rotor rotatably coupled to the drive assembly for rotating about a rotational axis that is coaxial with the drive axis.

7 Claims, 3 Drawing Sheets

(56) References Cited

U.S. PATENT DOCUMENTS

| | | | | |
|---|---|---|---|---|
| 4,320,986 | A | 3/1982 | Morrison | |
| 4,614,463 | A | 9/1986 | Hughes | |
| 4,740,348 | A * | 4/1988 | Rose | E04F 21/248 264/296 |
| 4,799,282 | A | 1/1989 | Fischer | |
| 4,925,341 | A | 5/1990 | Neal | |
| 5,108,220 | A | 4/1992 | Allen et al. | |
| 5,372,452 | A | 12/1994 | Hodgson | |
| 5,405,216 | A | 4/1995 | Allen et al. | |
| 5,567,503 | A | 10/1996 | Sexton et al. | |
| 5,613,801 | A | 3/1997 | Allen | |
| 5,816,740 | A | 10/1998 | Jaszkowiak | |
| 6,053,660 | A | 4/2000 | Allen et al. | |
| 6,058,922 | A | 5/2000 | Sexton | |
| 6,860,675 | B2 * | 3/2005 | Rose | E04F 21/248 404/112 |
| 7,004,676 | B2 * | 2/2006 | Williams | E04F 21/245 404/112 |
| 7,018,132 | B2 | 3/2006 | Ewer et al. | |
| 7,399,140 | B2 * | 7/2008 | Barcenas | E04F 21/248 404/112 |
| 7,775,740 | B2 | 8/2010 | Berritta | |
| 7,980,783 | B2 | 7/2011 | Jaszkowiak | |
| 8,132,984 | B2 | 3/2012 | Grahl | |
| 9,068,301 | B2 | 6/2015 | Fielder | |
| 11,193,286 | B2 * | 12/2021 | Del Real | E01C 19/42 |
| 11,859,395 | B2 * | 1/2024 | Del Real | E04F 21/247 |
| 11,927,022 | B2 * | 3/2024 | Richards | E04F 21/248 |
| 2002/0150426 | A1 | 10/2002 | Vandewinckel et al. | |
| 2006/0204336 | A1 | 9/2006 | Masterson et al. | |
| 2008/0216259 | A1 | 9/2008 | Walz et al. | |
| 2008/0289842 | A1 | 11/2008 | Chapple et al. | |
| 2010/0150653 | A1 | 6/2010 | Jaszkowiak | |
| 2012/0071066 | A1 | 3/2012 | Banchio | |
| 2013/0315667 | A1 | 11/2013 | Hanson et al. | |
| 2019/0006980 | A1 | 1/2019 | Sheeks et al. | |
| 2020/0263443 | A1 * | 8/2020 | Del Real | E04F 21/247 |
| 2022/0267968 | A1 | 8/2022 | Richards | |
| 2022/0268035 | A1 | 8/2022 | Richards | |
| 2022/0290448 | A1 * | 9/2022 | Reed | E04F 21/248 |
| 2024/0200343 | A1 * | 6/2024 | Richards | E04F 21/248 |

FOREIGN PATENT DOCUMENTS

| | | | |
|---|---|---|---|
| JP | H0893212 | A | 4/1996 |
| JP | 3039124 | U | 7/1997 |
| JP | 2004225523 | A | 8/2004 |
| JP | 2018199953 | A | 12/2018 |
| KR | 100517666 | B1 | 9/2005 |
| KR | 1020140117222 | A | 10/2014 |
| WO | 2013043117 | A1 | 3/2013 |

OTHER PUBLICATIONS

BCRS Equipment, "Whiteman J36E2 Electric Power Trowel w/ Standard Handle," <https://www.bcrsequipment.com/whiteman-j36e2-electric-power-trowel-w-standard-handle.html> web page publicly available at least as early as Jan. 13, 2021.

Bosch, "Cut Downtime with Just One Click," <https://xlock.boschtools.com/> web page publicly available at least as early as Jan. 13, 2021.

Extended European Search Report for Application No. 22760376.8 dated Apr. 3, 2025 (9 pages).

* cited by examiner

CONCRETE TROWEL

CROSS-REFERENCE TO RELATED APPLICATIONS

This application claims priority to U.S. Provisional Patent Application No. 63/153,057 filed on Feb. 24, 2021, the entire content of which is incorporated herein by reference.

FIELD OF THE INVENTION

The present invention relates to powered concrete trowels, and more particularly to battery powered concrete finishing trowels.

BACKGROUND OF THE INVENTION

Powered concrete trowels are typically used for finishing concrete surfaces and generally include a gas-powered motor mounted on a frame or "cage" that surrounds a rotor having a plurality of concrete trowel blades. The motor typically includes a rotatable output (e.g., an output shaft) oriented parallel to a work surface and linked to the rotor by a combination of a belt drive and a worm-style gear box. The rotor is rotatably driven by the rotatable output of the motor, which rotates the blades on a concrete surface. The trowel is controlled by an operator via a handle extending from the cage. However, many gas-powered trowels are noisy to use and are unable to fit in tighter workspaces. In addition, traditional worm gear mechanisms can be unreliable in the long run and lead to substantial power losses in the rotor drive system.

SUMMARY OF THE INVENTION

The present invention provides, in one aspect, a concrete trowel including a frame, a drive assembly including an electric motor mounted on the frame having an output shaft extending from the motor defining a drive axis, a guide handle extending from the frame for controlling the trowel, a battery pack for supplying electrical power to the motor, and a rotor including a plurality of blades, the rotor rotatably coupled to the drive assembly for rotating about a rotational axis that is coaxial with the drive axis.

In another aspect, the present invention includes a concrete trowel having a frame, a drive assembly including an electric motor mounted on the frame having an output shaft extending from the motor defining a drive axis, a post extending from the frame, a pair of handlebars coupled to the post for controlling the trowel, a battery pack for supplying electrical power to the motor, and a rotor including a plurality of blades, the rotor rotatably coupled to the drive assembly for rotating about a rotational axis that is coaxial with the drive axis.

In yet another aspect, the present invention includes a concrete trowel that includes a frame, a drive assembly including an electric motor mounted on the frame having an output shaft extending from the motor defining a drive axis, a battery pack for supplying electrical power to the motor, a rotor including a plurality of blades, the rotor rotatably coupled to the drive assembly for rotating about a rotational axis that is coaxial with the drive axis, a post extending from the frame, a pair of handlebars coupled to the post for controlling the trowel, an operator control unit mounted on one of the handlebars, wherein the operator control unit includes an ON/OFF switch and a speed adjustment switch, and a blade pitch adjustment knob mounted on one of the handlebars wherein the blade pitch adjustment knob is rotatable to selectively change a pitch of the plurality of blades on the rotor relative to the work surface.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
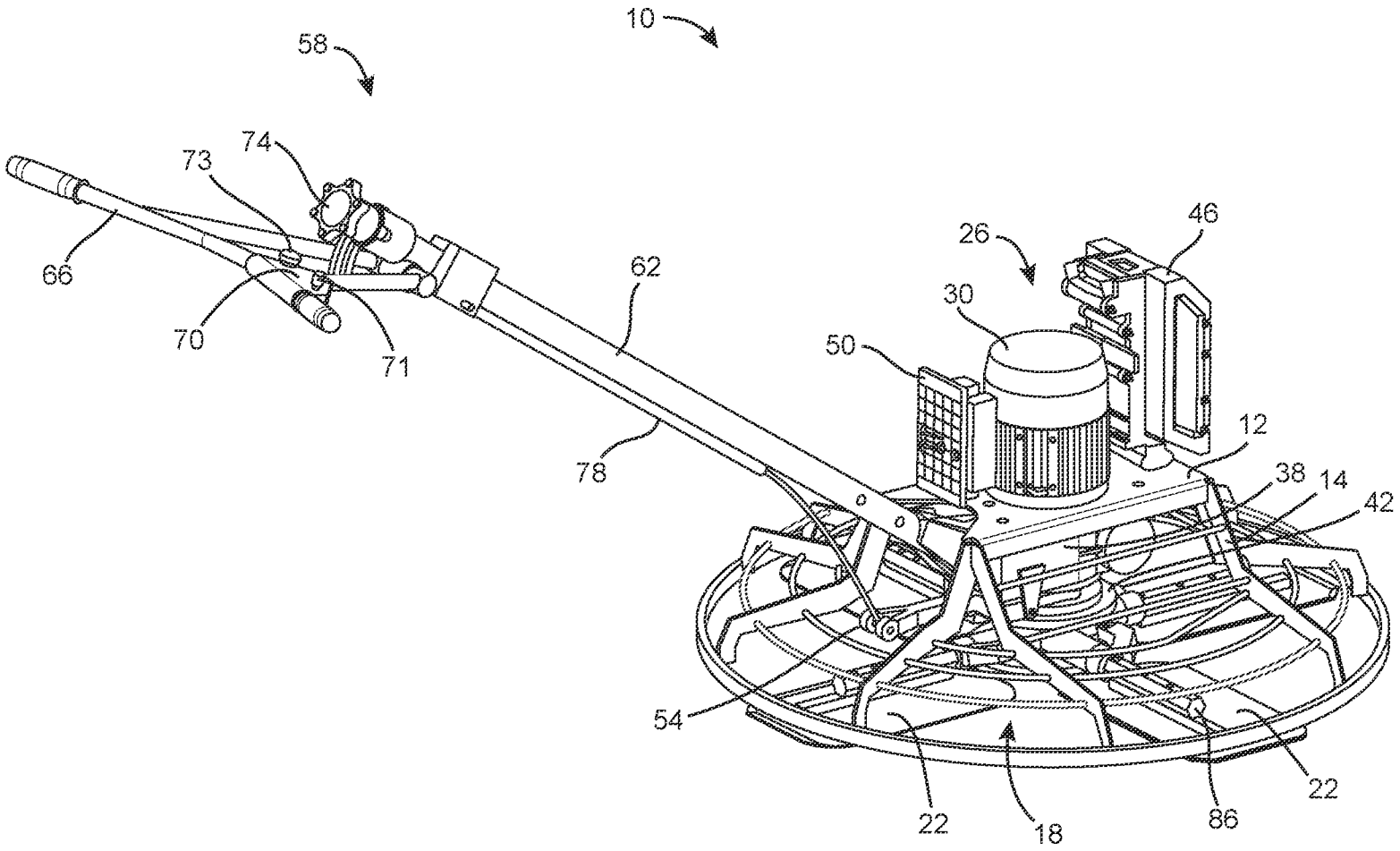
FIG. 1 is perspective view of a concrete trowel according to an embodiment of the invention.

FIG. 1 illustrates a concrete trowel 10 including frame 12 having a blade guard 14 surrounding a rotor 18 having a plurality of blades 22, a drive assembly 26 mounted on the frame 12 having a motor 30 (e.g., a brushless direct current electric motor) with an output shaft 32 extending from the motor 30 (FIG. 2) and defining a drive axis 34 that is perpendicular to a work surface. A gear box 38 is coupled to the motor 30 having a drive hub 42. The drive assembly 26 is powered by a battery pack 46 supported by the frame 12 and in selective electrical communication with the motor 30 to provide electrical power to the motor 30. In some embodiments of the trowel 10, the battery pack 46 and the motor 30 can be configured as an 80 Volt high power battery pack 46 and motor 30, such as the 80 Volt battery pack and motor disclosed in U.S. patent application Ser. No. 16/025,491 filed on Jul. 2, 2018 (now U.S. Patent Application Publication No. 2019/0006980), the entirety of which is incorporated herein by reference. It is to be understood that the motor 30 may be a combustion engine and in such a case, in lieu of a battery pack 46, the concrete trowel 10 may include a fuel cell and a fuel injection system, or carburetion system, in fluid communication with the motor 30.

In other embodiments of the concrete trowel 10, the motor 30 can be configured as a brushed motor, or any other type of electric motor known to someone having ordinary skill in the art.

Figure 2:
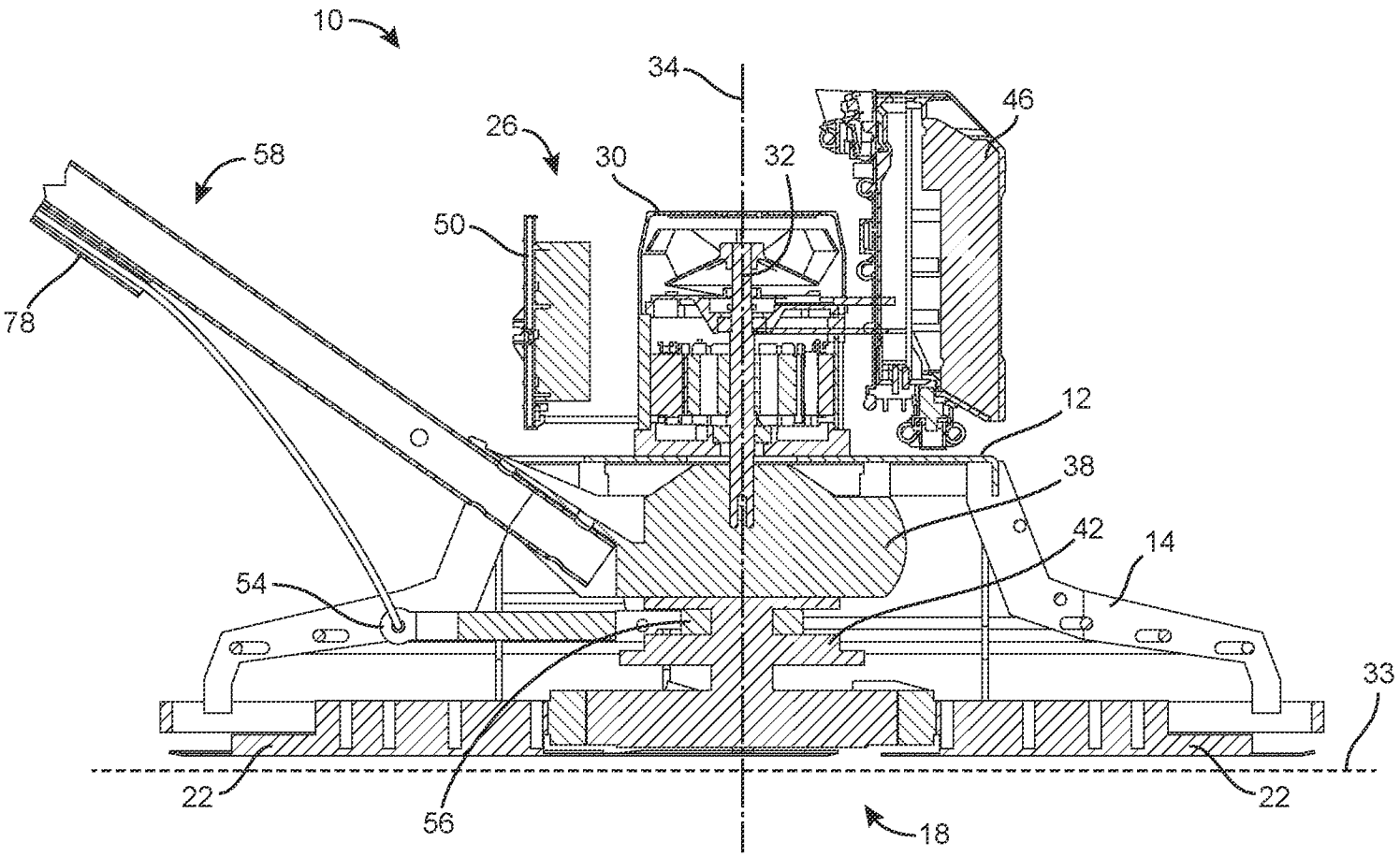
FIG. 2 is a side, partial cutaway view of the concrete trowel of FIG. 1.

With reference to FIGS. 1 and 2, the motor 30 is configured to supply torque to the gear box 38 via the output shaft 32, rotatably driving the drive hub 42 and rotor 18 to rotate the blades 22. The motor 30 is oriented on the frame 12 such that the output shaft 32 extends from the motor 30 in a direction perpendicular to a work surface 33. In some embodiments of the trowel 10, the drive assembly 26 can be a direct drive system where the output shaft 32 is coaxial with and directly connected to the drive hub 42 to rotatably drive the rotor 18, without the intervening gear box 38. In other embodiments, the motor 30 can be mounted onto the frame 12 such that the output shaft 32 is oriented parallel with the work surface 33 and the gear box 42 may include a right-angle configuration to orient the drive hub 42 perpendicular to the work surface 33.

In other embodiments of the drive assembly 26, the output shaft 32 can transfer torque to the rotor 18 in order to rotate the blades 22 about the rotational axis via a continuous drive member, such as a V-belt, synchronous belt, chain, etc.

With reference to FIG. 2, the concrete trowel 10 further includes a controller 50 (including, amongst other components, a printed circuit board having one or more microprocessors and multiple field-effect transducers for driving the motor 30), a blade adjustment yoke 54 pivotably coupled to a tilt plate 56 on the drive hub 42, and a handle assembly 58 including a post 62 extending obliquely from the frame 12 and handlebars 66 coupled to the post 62. The handle assembly 58 further includes an operator control unit 70 mounted on one of the handlebars 66 having a plurality of operator controls (e.g., an ON/OFF switch 71, a speed adjustment switch 73, etc.) for providing an input signal to the controller 50, and a blade pitch adjustment knob 74 having an adjustment cable 78 coupled to the blade adjustment yoke 54. The blade pitch adjustment knob 74 is configured to selectively tension the adjustment cable 78, thereby pivoting the adjustment yoke 54 and moving the tilt plate 56 with respect to the drive hub 42, which adjusts the pitch of the blades 22 relative to the work surface 33.

While the battery pack 46 is shown supported on the frame 12 in FIG. 1, in other embodiments of the trowel 10, it is to be understood that the battery pack 46 may be supported on the post 62 or on the handlebars 66 (e.g., on either one or both of the handlebars 66). Further, the battery pack 46 may be supported in a backpack worn by a user and electrically connected to the motor 30 via a cord. Additionally, the battery back 46 may be supported in some other offboard location relative to the concrete trowel 10 and connected to the concrete trowel 10 via a cord.

Figure 3:
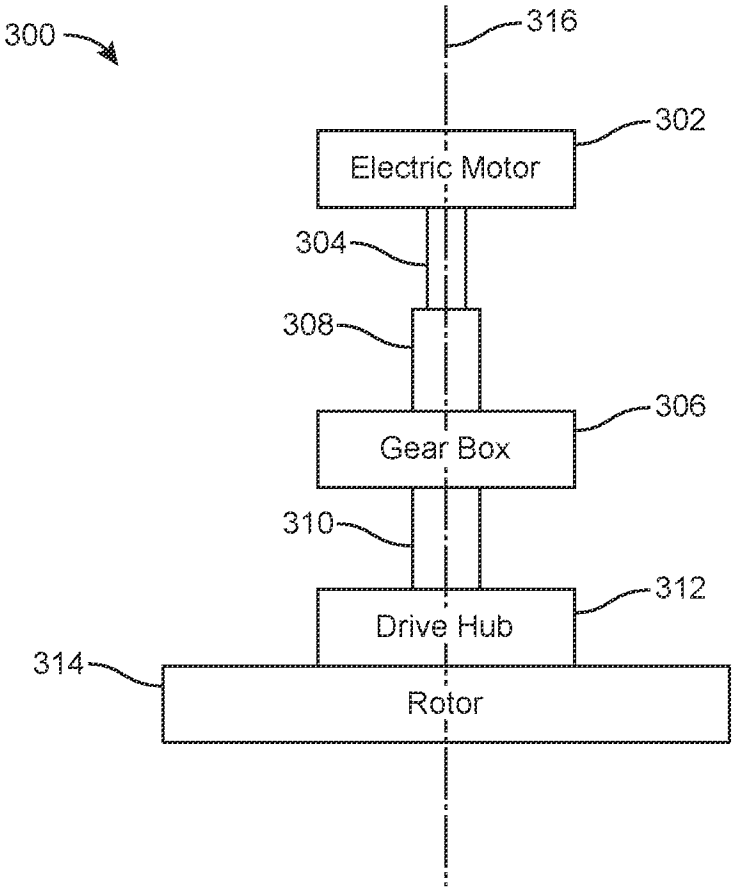
FIG. 3 is a schematic diagram of a drive assembly according to an embodiment of the invention.

FIG. 3 is a schematic diagram of a drive assembly 300. As illustrated, the drive assembly 300 includes an electric motor 302 that has an output shaft 304. A gear box 306 having an input shaft 308 and an output shaft 310 is operatively coupled to the electric motor 302. Specifically, the input shaft 308 of the gear box 306 is operatively coupled to the output shaft 304 of the electric motor 302. A drive hub 312 is operatively coupled to the output shaft 310 of the gear box 306. Further, a rotor 314 is removably engaged with the drive hub 312. The electric motor 302, the output shaft 310 of the electric motor 302, the gearbox 306 and the input shaft 308 and output shaft of the gear box 306, the drive hub 312, and the rotor 314 are all coaxial along a rotational axis 316 that is coaxial with the drive axis 34 (FIG. 2). As the output shaft 304 of the electric motor 302 rotates, that movement is transmitted through the gear box 306 to the drive hub 312 via the shafts 304, 308, 310 to rotate the drive hub 312 and the rotor 314 connected therewith.

Since the trowel 10 is configured as a battery powered system utilizing the battery pack 46 to electrically power the electric motor 30, this allows the trowel 10 to operate in enclosed spaces and in environments that have sensitive dust and noise requirements where gas-powered trowels would not have been previously allowed to operate. Additionally, by eliminating a gas-powered engine, costly maintenance is eliminated, and the operator isn't exposes to carbon monoxide exhausted by the engine. Furthermore, a battery powered system simplifies operation of the trowel 10 by eliminating the need for a power cord that would have otherwise require an additional operator to guide during use and produce an unwanted tripping hazard. Also, because there is no power cord, a separate generator for producing electrical power to power the trowel 10 isn't required on the jobsite, which saves both time and money.

Although the invention has been described in detail with reference to certain preferred embodiments, variations and modifications exist within the scope and spirit of one or more independent aspects of the invention as described.

Various features of the invention are set forth in the following claims.

What is claims is:

1. A concrete trowel comprising:

a frame;

a drive assembly including an electric motor mounted on the frame having an output shaft extending from the motor defining a drive axis, a gear box having an input shaft that is rotatably driven by the output shaft of the motor, and a drive hub coupled to an output shaft of the gear box for rotation with the output shaft;

a post extending from the frame;

a pair of handlebars coupled to the post for controlling the trowel;

a battery pack for supplying electrical power to the motor;

a rotor including a plurality of blades, the rotor rotatably coupled to the drive assembly for rotating with the drive hub, wherein the output shaft of the motor, the input shaft and output shaft of the gear box, the drive hub, and the rotor are all coaxial along a rotational axis that is coaxial with the drive axis;

a blade pitch adjustment knob coupled to the post or the handlebars;

a blade adjustment yoke pivotably coupled to the drive hub; and an adjustment cable having a first end coupled to the blade adjustment yoke, wherein the blade pitch adjustment knob is coupled to a second end of the adjustment cable, and wherein the blade pitch adjustment knob is configured to selectively tension the adjustment cable and pivot the blade adjustment yoke with respect to the drive hub, and wherein pivoting the blade adjustment yoke adjusts a pitch of the blades relative to the work surface.

2. The concrete trowel of claim 1, wherein the drive hub is configured to transfer torque to the rotor.

3. The concrete trowel of claim 2, wherein the output shaft is oriented perpendicular to a work surface.

4. The concrete trowel of claim 1, further comprising an operator control unit mounted on one of the handlebars.

5. The concrete trowel of claim 4, wherein the operator control unit includes an ON/OFF switch.

6. The concrete trowel of claim 5, wherein the operator control unit further includes a speed adjustment switch.

7. The concrete trowel of claim 1, wherein the battery pack is supported on the frame.

* * * * *